US007037028B1

(12) United States Patent
Donohoe et al.

(10) Patent No.: US 7,037,028 B1
(45) Date of Patent: May 2, 2006

(54) SECURITY BARRIER

(75) Inventors: Dale R. Donohoe, Santa Clarita, CA (US); Jeffrey G. Anderson, Santa Clarita, CA (US); Joe L. Lopez, Santa Clarita, CA (US); Greg L. Cook, Glendale, CA (US); Kenneth J. Best, Alexandria, VA (US); Rodney P. Shreckengost, Newhall, CA (US); Robert L. Lyon, Agua Dulce, CA (US); John T. Garrett, Newhall, CA (US)

(73) Assignee: Intertex Barriers & Booths, Inc., Valencia, CA (US)

( * ) Notice: Subject to any disclaimer, the term of this patent is extended or adjusted under 35 U.S.C. 154(b) by 60 days.

(21) Appl. No.: 10/837,122

(22) Filed: Apr. 30, 2004

Related U.S. Application Data

(60) Provisional application No. 60/467,087, filed on May 1, 2003.

(51) Int. Cl.
*E01F 13/00* (2006.01)
*E01F 13/12* (2006.01)

(52) U.S. Cl. ..... 404/6; 49/49

(58) Field of Classification Search ..... 404/6–11; 256/13.1; 49/49
See application file for complete search history.

(56) References Cited

U.S. PATENT DOCUMENTS 1,344,776 A * 6/1920 Strieter ..... 246/126
1,611,293 A * 12/1926 Tausch ..... 104/254
1,706,318 A * 3/1929 Orr ..... 246/129
1,929,859 A * 10/1933 Strauss ..... 246/29 R
4,576,509 A * 3/1986 Beaty, Sr. ..... 404/6
4,818,136 A * 4/1989 Nasatka et al. ..... 404/6
4,822,207 A * 4/1989 Swahlan ..... 404/6
4,850,737 A * 7/1989 Nasatka et al. ..... 404/6
4,893,119 A * 1/1990 Nasatka ..... 340/928
5,245,787 A * 9/1993 Swenson et al. ..... 49/34
5,498,100 A * 3/1996 Guernsey ..... 404/6
5,634,738 A * 6/1997 Jackson et al. ..... 404/6
5,680,729 A * 10/1997 Heffington ..... 49/362
6,485,225 B1 * 11/2002 Baker ..... 404/6
6,845,589 B1 * 1/2005 Thompson et al. ..... 49/49
6,926,462 B1 * 8/2005 Fuganti et al. ..... 404/6
2005/0031411 A1 * 2/2005 Hensley ..... 404/11
2005/0069385 A1 * 3/2005 Quenzi et al. ..... 404/114

* cited by examiner

*Primary Examiner*—Raymond Addie
(74) *Attorney, Agent, or Firm*—Richard S. Erbe

(57) ABSTRACT

A security barrier includes a horizontal composite beam extending across a roadway is mounted between vertical posts at either end of the beam. Hydraulic cylinders fastened at each beam end and to the vertical posts cause the beam to be raised and lowered, as needed. When the beam is at its lowest position, it allows for the normal flow of traffic over the top of the beam. When the beam is in its fully-raised position, it provides a vehicle barrier thirty-six inches above grade. A hydraulic power unit and components control the direction and speed of beam movement.

The security barrier also includes electronic control and monitoring of the beam, and hydraulic system.

18 Claims, 9 Drawing Sheets

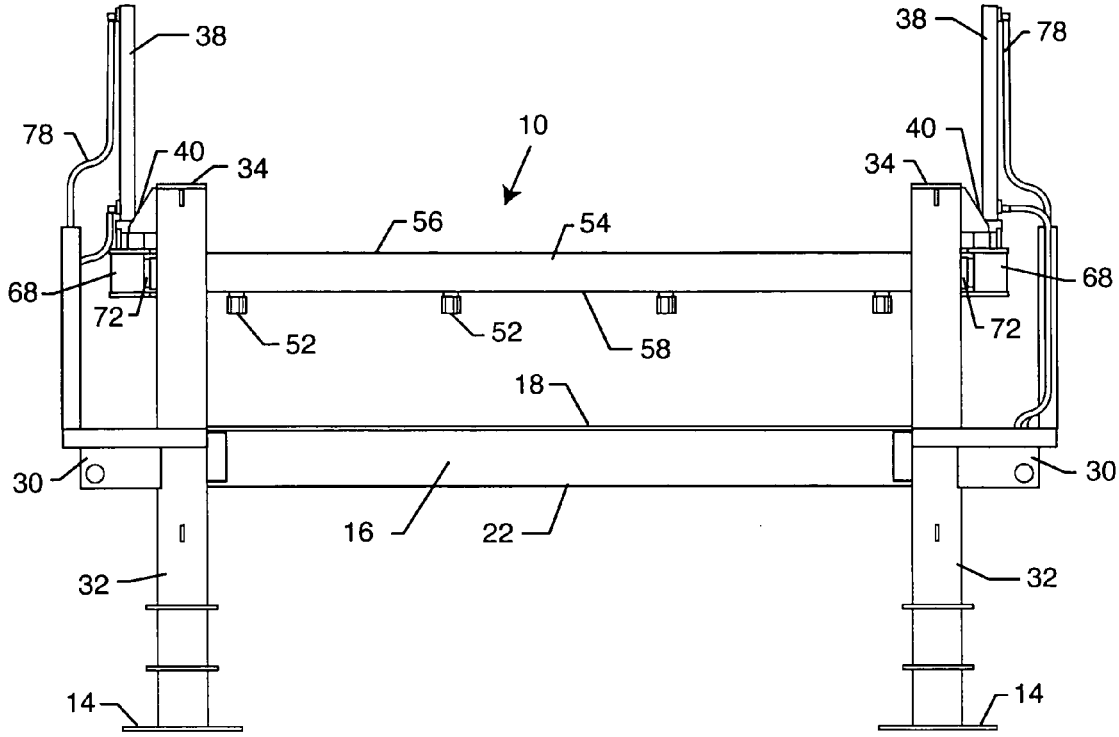
FIG. 5
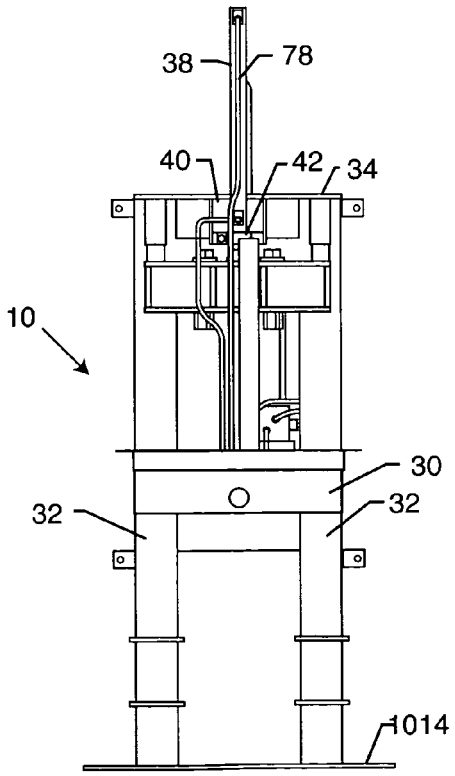
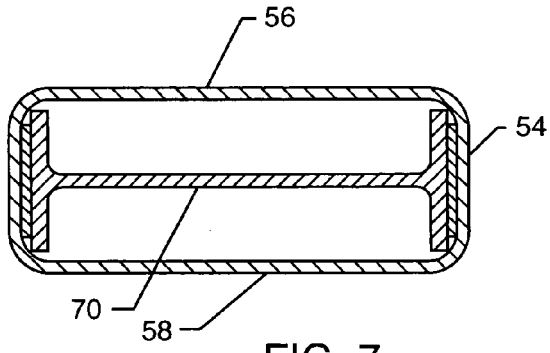
FIG. 7
FIG. 6

SECURITY BARRIER

RELATED APPLICATIONS

This application claims the benefit of U.S. Provisional Patent Application No. 60/467,087, filed May 1, 2003, incorporated herein by reference.

BACKGROUND OF THE INVENTION

1. Field of the Invention

The present invention relates to security devices, and more particularly to an apparatus and system that can rapidly block access to vehicular and pedestrian traffic during an emergency, but which can also allow for the orderly flow and control of traffic during non-emergency situations.

2. General Background and State of the Art

The need to control access to secure facilities by vehicular traffic and pedestrians, particularly to national consulates and embassies, has never been more important. Since the Sep. 11, 2001, World Trade Center attacks, the threat to government and secure facilities and the need to protect them, has become a high priority.

Several forms of roadway security barriers have been used to control access by vehicles to facilities. Concrete barriers rely on a large foundation or a significant reaction mass to provide an obstacle to vehicle traffic. Such foundations are visually intrusive, may take up a great deal of space, and often make it difficult for authorized vehicles to gain access to the facilities.

Guard gates having moving fences controlled by personnel can be effective for controlling the flow of pedestrian access to facilities, but they generally are not very effective for stopping vehicles, especially large ones, which can break right through them.

Another problem inherent in known roadway security barriers, especially those having enough mass to stop a large vehicle, is that they are slow to react and are not effective in stopping pedestrians.

Security barriers for vehicles at consulates and embassies should satisfy the requirements of United States Department of State Publication (DOS) SD-SDT-02.01, entitled "Vehicle Crash Testing of Perimeter Barriers and Gates" (April 1985). This publication specifies a crash rating of L12/L3, which is defined being able to block a 15,000 pound vehicle moving at 50 mph with a barrier deflection of three feet permitted. The Department has no crash rating for pedestrian gates.

There exists, therefore, a need for a security barrier for vehicles which is fast-acting and satisfies DOS SD-SDT-02.01.

There also exists a need for security barrier for vehicles that is flexible enough to include dynamic gates to control access by pedestrians.

No known security barrier or system, either by themselves or in combination, is seen to anticipate or suggest the apparatus and systems disclosed and claimed herein.

SUMMARY OF THE INVENTION

Accordingly, it is an object of the invention to provide a security barrier apparatus and system that can be deployed rapidly in an emergency.

Another object of the invention is to provide a security barrier apparatus and system that can allow the free flow of vehicular traffic when it is not deployed.

Another object of the invention is to provide a security barrier apparatus and system that has an adjustable deployment time.

A further object of the invention is to provide a security barrier apparatus and system that has more than one mode of operation.

A further object of the invention is to provide a security barrier apparatus and system that meets the crash rating standard of DOS publication SD-SDT-02.01.

Still another object of the invention is to provide a security barrier apparatus and system that provides real time status of the device and system components.

Yet another object of the invention is to provide a security barrier apparatus and system that is flexible enough to provide for the addition of a horizontally moving pedestrian gate.

It is another object of the invention to provide a security barrier apparatus and system that is flexible enough to provide for the addition of a vertically moving pedestrian gate.

A further object of the invention is to provide a security barrier apparatus and system that may be adapted to differing roadway widths.

These and other objectives are achieved by the present invention, which, in a broad aspect, provides a security barrier formed by composite horizontal steel beam mounted between vertical posts. At each end of the beam are vertical posts and a cross channel joined to the posts. The barrier spans the width of an access roadway, and so may be made in varying lengths, depending on the width of the roadway where the barrier is constructed.

The barrier includes single acting hydraulic actuators for lifting the beam vertically. One actuator is located at each beam end and attached at its lower end to the beam by a spherical joint. The body of each actuator is also attached to one of the vertical posts.

In the preferred embodiment of the invention, the posts are mounted below grade in an excavation and extend several feet above grade. A pan with a lip extending about its perimeter is attached to the posts such that the lip is located at grade, and the sidewalls and bottom of the pan located below grade. The pan is sized so that when the beam is in its lowest position, it fits inside the pan and vehicles can travel over it unimpeded.

Vertical movement of the beam is achieved by retracting each actuator at an equal rate, thereby keeping the beam horizontal with respect to the roadway at all times. This synchronized motion is provided by hydraulic fluid flow, which is split evenly by a flow-dividing valve supplying hydraulic fluid to each actuator. Downward motion is likewise synchronized by the even flow-combining feature of the same valve.

The barrier device of the present invention operates in two modes; a normal mode and an emergency mode. A key aspect of the present invention includes the ability to raise the beam of the barrier very rapidly in either mode, but especially in the emergency mode. Prior art devices for the purpose of blocking roadways take several seconds, some as long as thirty seconds, to close off a vehicle roadway to traffic. In the emergency mode, the present invention can close the roadway in less than two seconds by raising the beam from its fully-lowered position to fully raised position.

When the beam is in its fully-lowered position, the top of the beam is flush with the existing grade and vehicles may travel freely over it and across the barrier. In its fully raised position, the beam presents an obstacle thirty-six inches above grade. The vertical posts at each end constrain the beam in the event of a vehicle collision with the barrier. Impact force is transmitted through the beam to the posts. Each post is anchored by a subterranean concrete and rebar reinforced structure sufficient to restrain the vehicle from forward movement.

A hydraulic power unit generates the hydraulic flow and pressure for raising the beam. The hydraulic power unit includes an electrically driven hydraulic pump, which provides flow to hydraulic storage accumulators. These accumulators supply hydraulic fluid flow to electrically controlled solenoid valves, which direct flow to the flow dividing valve. Beam vertical speed in the up and down directions is controlled and may be manually adjusted independently by flow control valves.

The security barrier of the present invention also includes a provision allowing the addition of a dynamic pedestrian gate to block access to a facility by pedestrians. Either a vertically-moving or horizontally-moving pedestrian gate may be incorporated with the beam.

Pedestrian gate motion is controlled by two methods, depending on the gate type. The vertically-moving gate is operated by a hydraulic cylinder, which acts upon cables to lift the gate and to keep it level with respect to the roadway. The horizontal sliding gate is operated by a rotary motor, either hydraulic or electric, depending on the size and weight of the sliding gate.

An electrical enclosure mounted on the hydraulic power unit contains an industrial programmable controller that controls the actuation and monitoring of beam and gate movements. For that reason, the sequence of beam and gate motion is programmable and predetermined.

Inductive non-contact proximity switches connected to the programmable controller monitor the positions of the beam and gate. Other devices that may be monitored and controlled by the programmable controller include warning lamps, audible alarms, annunciators, and status lamps. Control of the beam and gate is accomplished by operator panels with pushbuttons, remote computer control, key switches, and keypad or card access readers.

The security barrier of the present invention has been field tested and meets the crash rating standard of DOS publication SD-SDT-02.01.

Further objects and advantages of this invention will become more apparent from the following description of the preferred embodiments, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which:

FIG. 5 illustrates a front elevation of an exemplary apparatus in accordance with the present invention with the beam in its deployed position;

FIG. 6 illustrates an end view of an exemplary apparatus in accordance with the present invention;

FIG. 7 illustrates a cross-sectional view taken at line 7—7 in FIG. 4;

DETAILED DESCRIPTION OF THE PREFERRED EMBODIMENTS OF THE INVENTION

Figure 1:
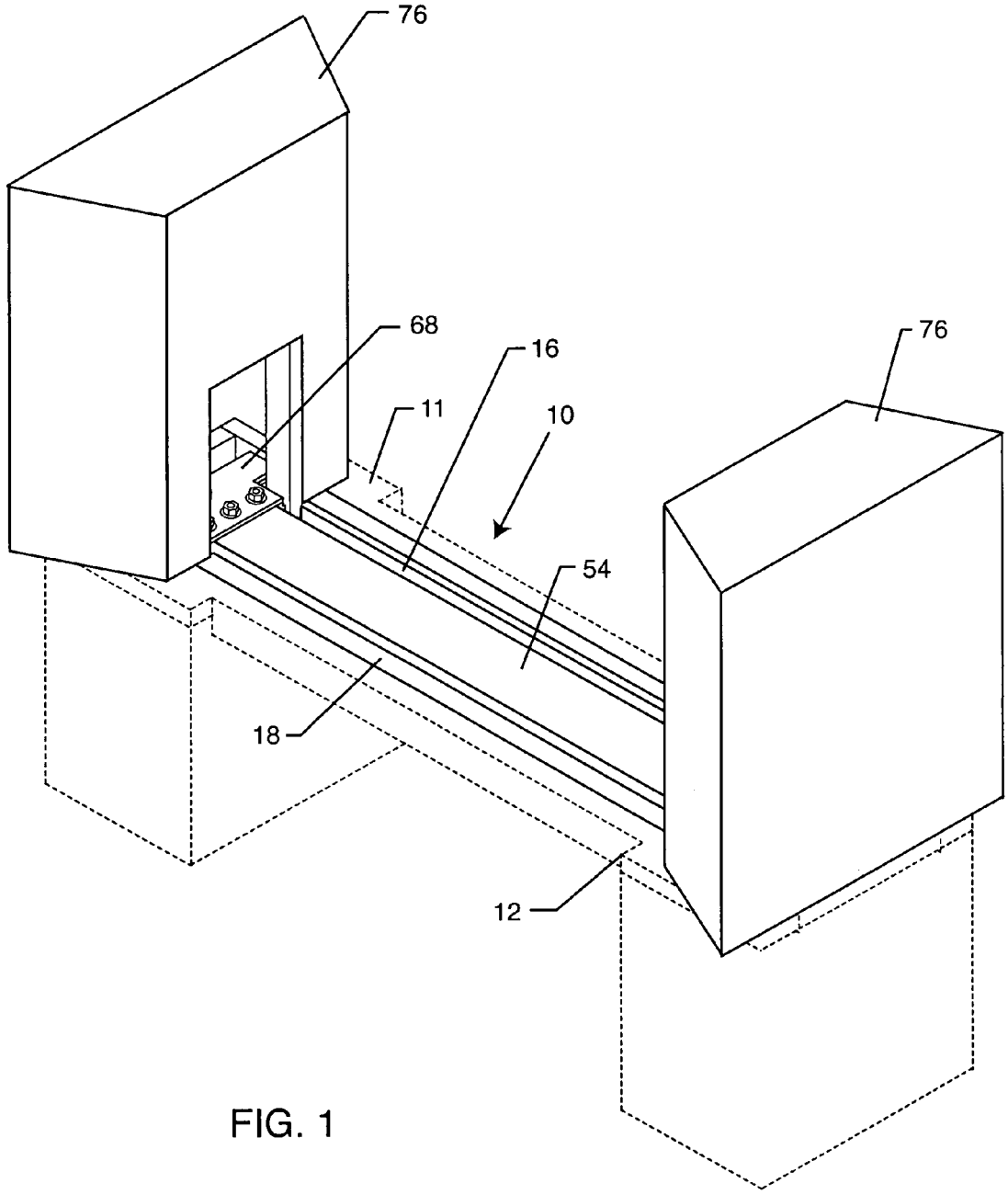
FIG. 1 illustrates a perspective view of an exemplary apparatus contained in an enclosure in accordance with the present invention.
Figure 2:
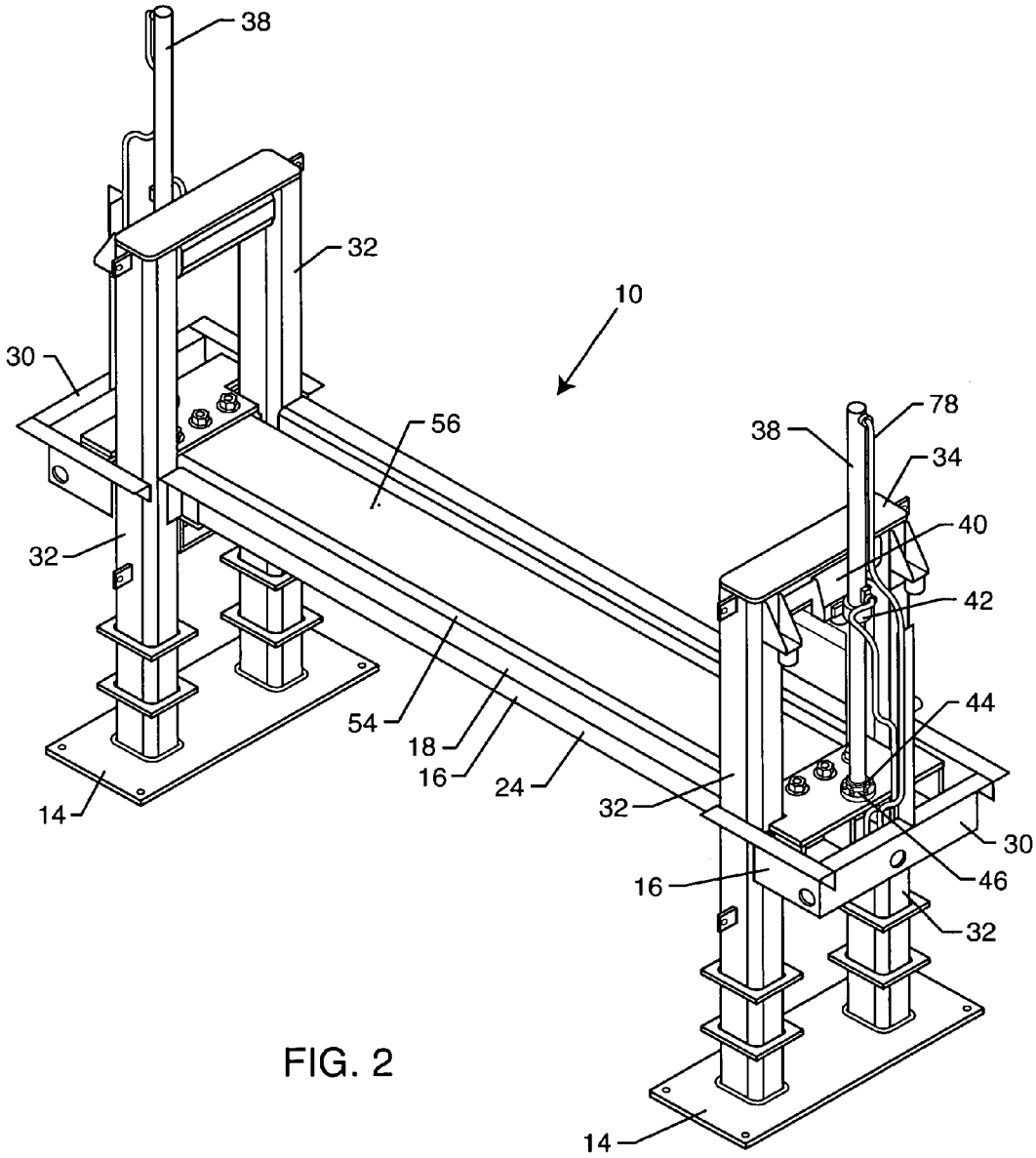
FIG. 2 illustrates a perspective view of an unenclosed exemplary apparatus in accordance with the present invention, with the beam in its undeployed (down) position.
Figure 3:
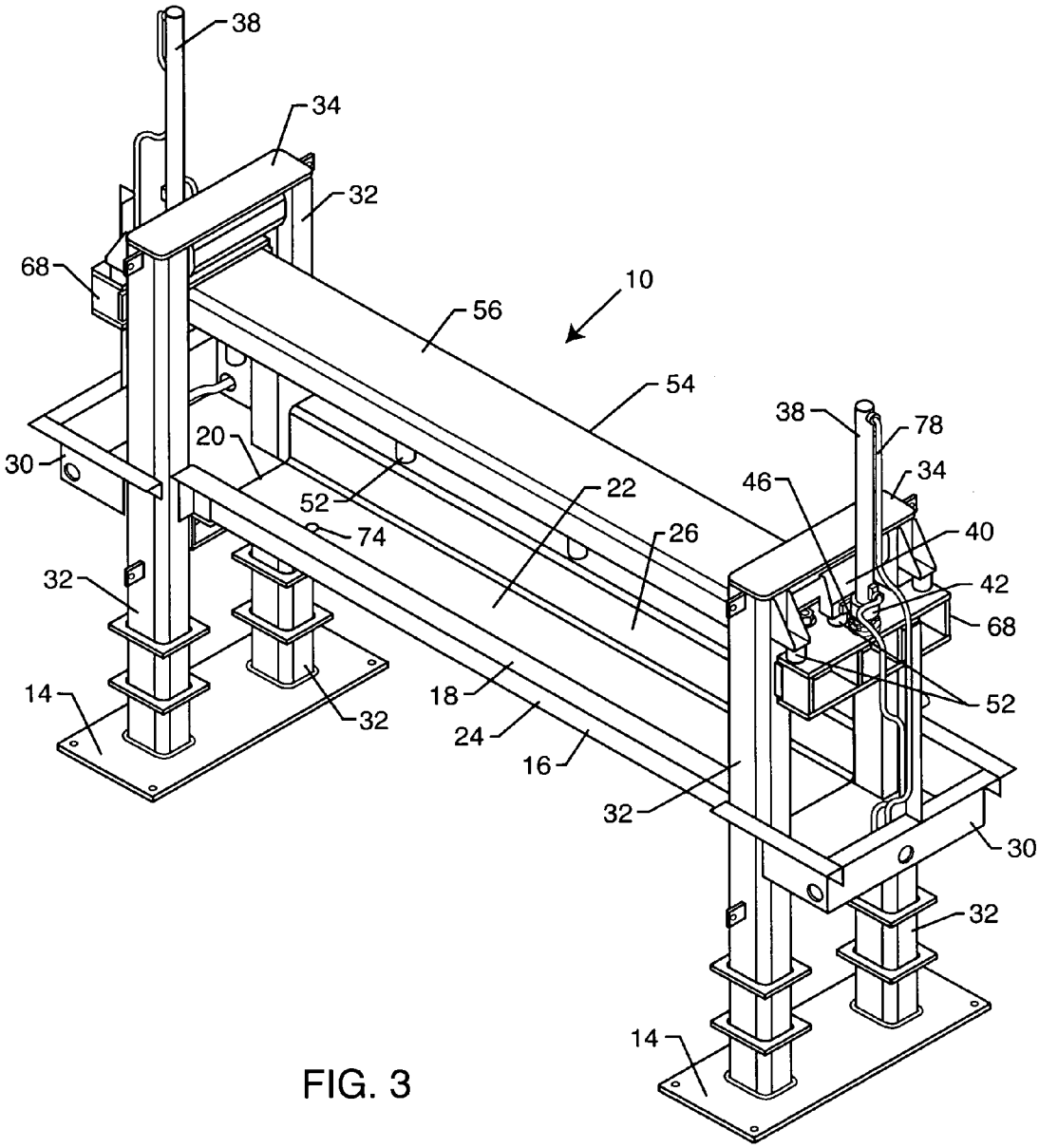
FIG. 3 illustrates a perspective view of an unenclosed exemplary apparatus in accordance with the present invention, with the beam in its deployed (up) position.
Figure 4:
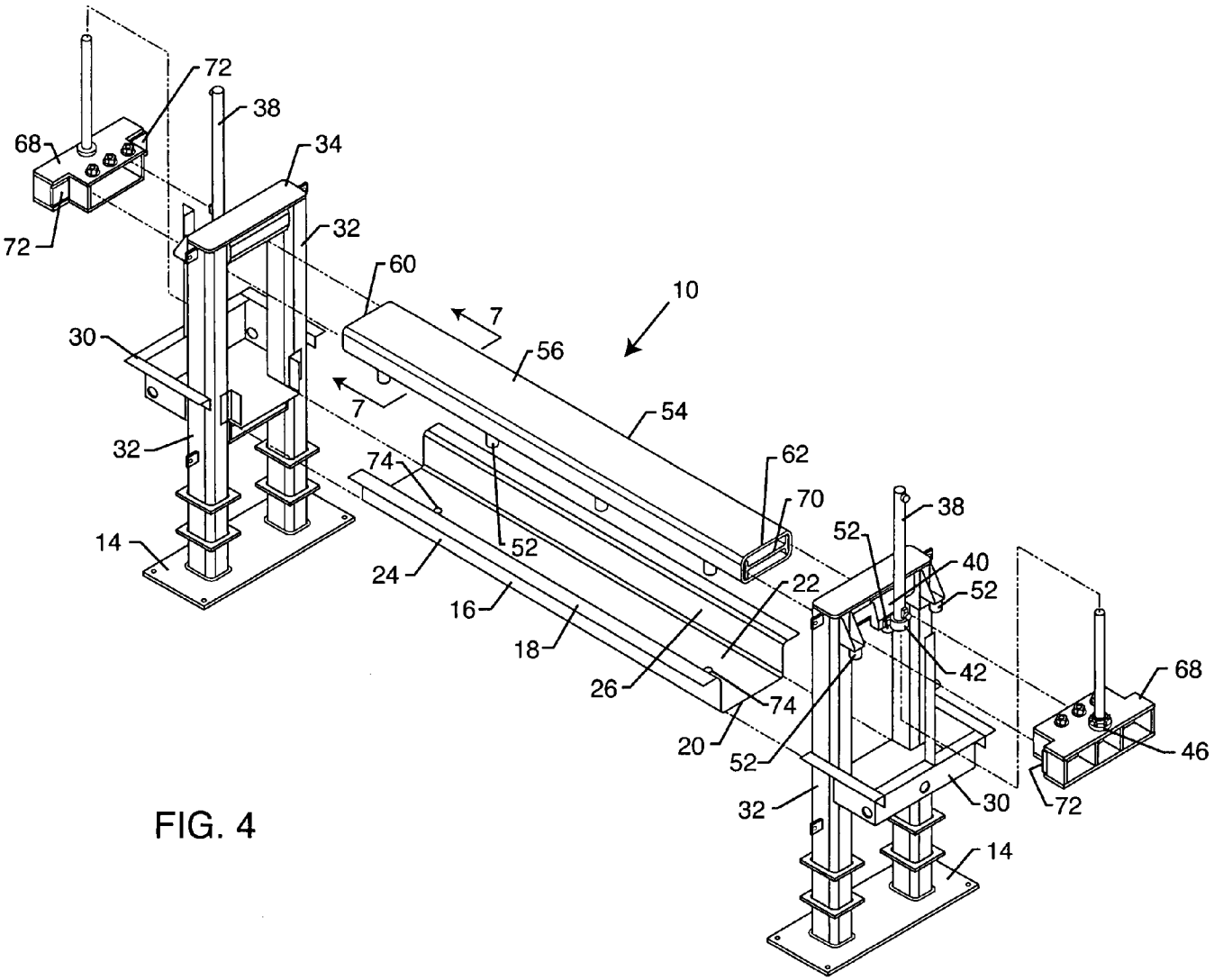
FIG. 4 illustrates an exploded view of an exemplary apparatus in accordance with the present invention.

In the following description of the present invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

A security barrier of the present invention is illustrated in FIGS. 1 through 7 and indicated generally by the numeral 10. Barrier 10 is mounted in an excavation 11 that is partly below grade 12. In the preferred embodiment of the invention, a pair of vertical posts 32 is mounted on a mounting plate 14 located below grade 12 at each end of barrier 10. Posts 32 extend above grade and are connected by top plate 34.

Pan 16 is attached to posts 32 such that lip 18 of pan 16 is generally at grade 12. Pan 16 further includes bottom 22, front wall 24 and rear wall 26. At each end of pan 16 is a pan mount end 30.

Composite beam 54 is configured to travel vertically between posts 32. In its deployed position, top 56 of beam 54 is in the proximity of top plates 34 about thirty-six inches above grade. In its lowered position, bottom 58 of beam 54 is in the proximity of pan bottom 22, and top 56 is at grade 12. In this position, vehicles can drive across top 56 of beam 54. Bumpers 52 on the bottom 58 of beam 54 are used to cushion any interactions between beam 54 and pan 16.

At each of first end 60 and second end 62 of beam 54 is attached a beam end cap 68 by means of nuts and bolts. End caps 68 also include wear plates 72 to reduce wear in barrier 10 components that otherwise could be caused by the vertical travel of beam 54. Drains 74 in pan bottom 22 allow for any accumulation of moisture, dirt and particulates to be easily flushed out by using pressurized water.

Beam 54 is constructed principally of steel tubing with an internal I-beam 70, as illustrated in FIG. 7. In actual use, many of the barrier components, such as posts 32, top plate 34, and beam end caps 68 may be hidden from view by use of enclosure 76, as illustrated in FIG. 1.

Movement of beam 54 upwards and downwards is achieved by the use of a pair of hydraulic actuators 38, one mounted near first end 60 and the other near second end 62 of beam 54. The lower end of each actuator 38 is secured to a beam end cap 68 by spherical joint 44 by the use of fasteners connecting flange 46 and mounting holes in the beam end cap. In the preferred embodiment of the invention, the upper end of each hydraulic cylinder 38 is attached to actuator mount 40 by means of a flexible ball socket 42. Actuator mount 40 is in turn secured to top plate 34. Flexible ball socket 42 allows each actuator 38 some freedom of movement when beam 54 is being moved up or down to compensate for any uneven movement of the beam ends.

Figure 8:
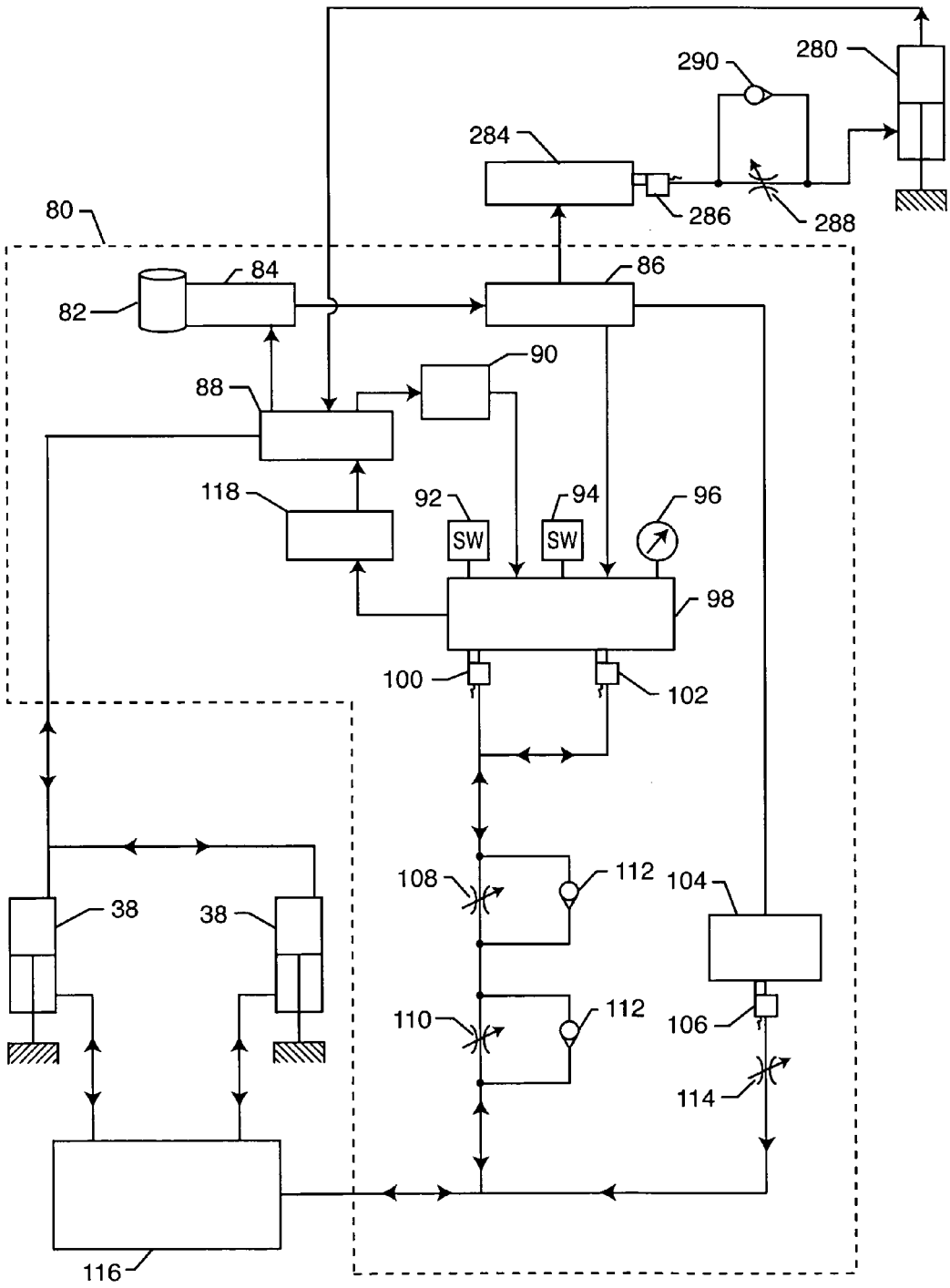
FIG. 8 illustrates schematic diagram of the hydraulic system of an exemplary apparatus in accordance with the present invention.

Vertical movement of the beam 54 is achieved by retracting each actuator 38 at an equal rate, thereby keeping beam 54 horizontal with respect to the roadway at all times. Actuators 38 are retracted by the use of hydraulic fluid routed through hydraulic lines 78 by hydraulic power unit 80, as illustrated in FIG. 8. Synchronization of the movement of actuators 38 is enabled by splitting the flow of fluid equally by flow dividing valve 116.

Hydraulic fluid is pressurized by pump 84, which is driven by motor 82. Pump 84 provides pressurized hydraulic fluid to accumulators 86 from reservoir 88. Pressurization and distribution of hydraulic fluid may also be achieved by means of manual hand pump 90. Filter 118 provides for removal of particulate and other contaminants to keep the hydraulic fluid clean.

The present invention provides two modes of operation, a normal mode and an emergency mode. In the normal mode of operation, beam 54 may be raised from grade 12 to its deployed height of about thirty-six inches in approximately five seconds, or such time as the system operator may choose. In the emergency mode of operation, beam 54 may be deployed in as little as two seconds.

In the normal mode of operation, pressurized fluid is conducted from accumulators 86 to valve manifold 98. Valve manifold 98 allows for flow to and from actuators 38. Valve manifold 38 also includes monitoring and control components such as high fluid pressure switch 92, low fluid pressure 94, and pressure gauge 96.

When the operator wishes to raise beam 54 in the normal mode of operation, solenoid valve 100 is enabled and allows fluid to flow towards the actuators 38. The rate at which the beam rises from grade level to its deployed level may be adjusted by using valve 108, which in the preferred embodiment of the invention is a needle valve, and which in conjunction with check valve 112 mounted in parallel, provides for adjustment of the flow rate of the fluid flowing to the actuators 38. Flow to the actuators is split evenly between actuators 38 by means of flow divider/combiner valve 116, thus keeping beam 54 substantially horizontal as it rises.

When the operator wishes to lower beam 54, solenoid valve 102 is enabled, allowing for hydraulic fluid to flow out of the actuators 38. The rate at which beam 54 is lowered from its deployed position to its position at grade 12 may be adjusted by using valve 110, which in the preferred embodiment of the invention is a needle valve, and which in conjunction with check valve 112 mounted in parallel, provides for adjustment of the flow rate of the fluid flowing from actuators 38. Flow returning to the system from actuators 38 is combined by means of flow divider/combiner valve 116, which enables the flow rates exiting the actuators to be even, thus keeping beam 54 substantially horizontal is it moves down.

In the emergency operation mode, solenoid valve 106 on emergency valve manifold 104 is enabled, adding to flow from valve manifold 98. The rate at which hydraulic fluid flows to flow divider/combiner valve 116 and actuators 38 may be adjusted by valve 114 and valve 108, which in the preferred embodiment of the invention are needle valves. In the emergency mode of operation, beam 54 may be raised from its position at grade 12 to its deployed position in about two seconds.

In the emergency mode of operation, flow divider/combiner valve 116 enables the flow of hydraulic fluid to be split evenly between actuators 38, thus meaning that beam 54 remains substantially horizontal as it moves. Beam 54 is lowered by enabling solenoid 102, as in the normal mode of operation.

Figure 9:
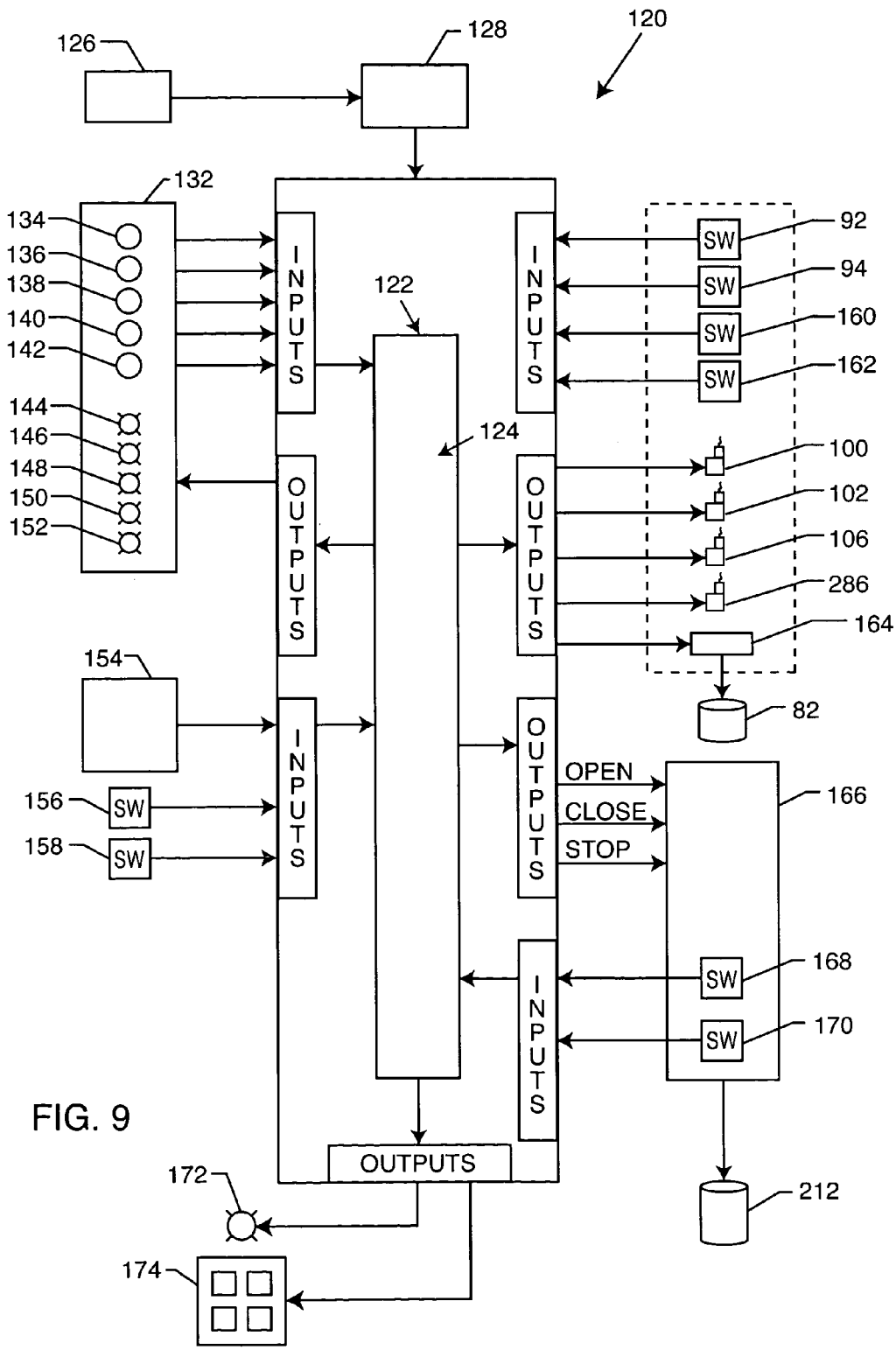
FIG. 9 illustrates a schematic diagram of the monitoring and control system of an exemplary apparatus in accordance with the present invention.

FIG. 9 illustrates a logic diagram of an electronic control and monitoring system 120 that manages and monitors the movement of beam 54. In the preferred embodiment of the invention, control and monitoring system 120 is contained in an enclosure mounted on hydraulic power unit 80. Control and monitoring system 120 includes programmable logic controller 122 in which is embedded control program 124, which includes all of the preprogrammed commands to control beam movement.

The control and monitoring system 120 is powered by power source 128, and activated by switch 126, which could be pushbutton or a key switch. The operator of the barrier may observe conditions and provide commands to control and monitoring system at operator panel 132, or annunciator panel 174.

Inductive non-contact proximity switches 156 and 158 on posts 32 monitor the position of beam 54. In the normal mode of operation, the beam may be raised by the operator by pressing button 136 on panel 132, which activates solenoid valve 100 and starts flow of hydraulic fluid to actuators 38. If required, motor starter 164 starts pump motor 82.

In the emergency mode of operation, when it is desired to raise beam 54 because of a threat, the operator can push button 134 on panel 132, which will activate solenoid valve 106 and deactivate solenoid valve 102. When the beam is in its fully-deployed up position, indicating lamp 144 will illuminate to inform the operator of the beam deployment.

For downward movement of beam 54, the operator presses button 138 on panel 132. Solenoid valve 102 is activated, enabling the flow of hydraulic fluid away from actuators 38. When beam 54 is in its down position, it will be detected by sensor 158, and indicator lamp 146 will illuminate, letting the operator know that the beam is in its lowest position.

Beam 54 may also be activated and raised by a signal from vehicle detector 154, which can detect the presence of an unauthorized vehicle in the vicinity of barrier 10.

Control and monitoring system 120 also receives inputs from high oil temperature switch 160, low reservoir oil level switch 162, high oil pressure switch 92, and low oil pressure switch 94. If switch 160 or 162 is tripped, check oil lamp 152 on panel 132 is illuminated. Other functions controlled and monitored by system 120 are traffic lamps 172 and annunciator panel 174.

Figure 10:
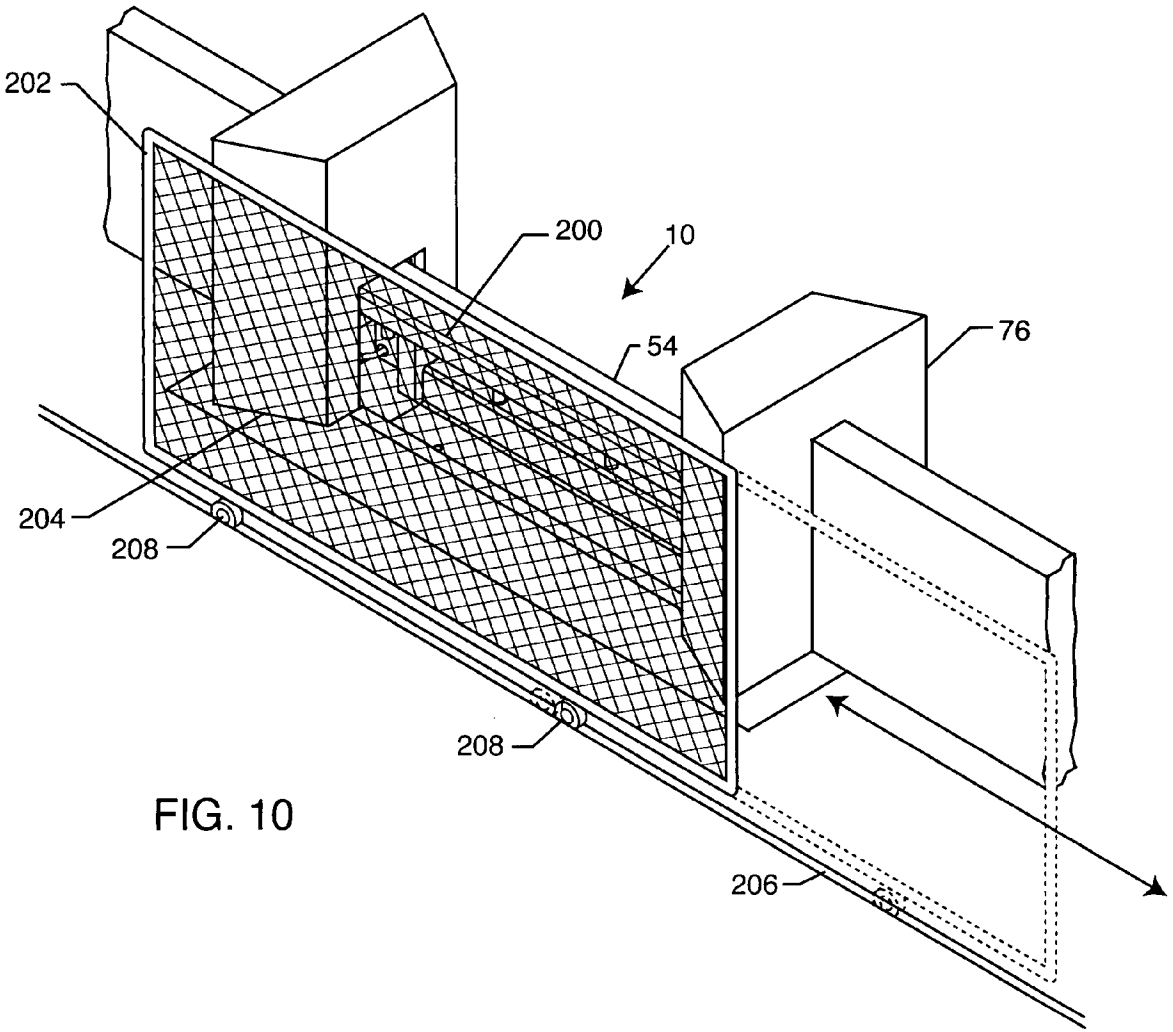
FIG. 10 illustrates a perspective view of an apparatus according to a second embodiment of the invention incorporating a horizontally-moving pedestrian fence.

FIG. 10 illustrates an alternative embodiment of the invention incorporating a pedestrian gate 200. In this embodiment of the invention, gate 200 moves horizontally along track 206. Gate 200 includes frame 202 and fencing material 204, which may be chain link fencing or the like. Gate 200 is opening and closed by wheels 208 moving along track 206. Gate motor 212 drives a chain system to achieve motion of the gate.

Control and monitoring system 120 may be expanded to control and monitor gate 200, as shown in FIG. 9. Panel 132 includes button 140 to open gate 200, and button 142 to close gate 200. Buttons 140 and 142 activate motor 212. Gate position is monitored by gate open switch 168 and gate closed switch 170. The status of the gate is indicated on panel 132 by illumination of gate open lamp 148 or gate closed lamp 150.

Figure 11:
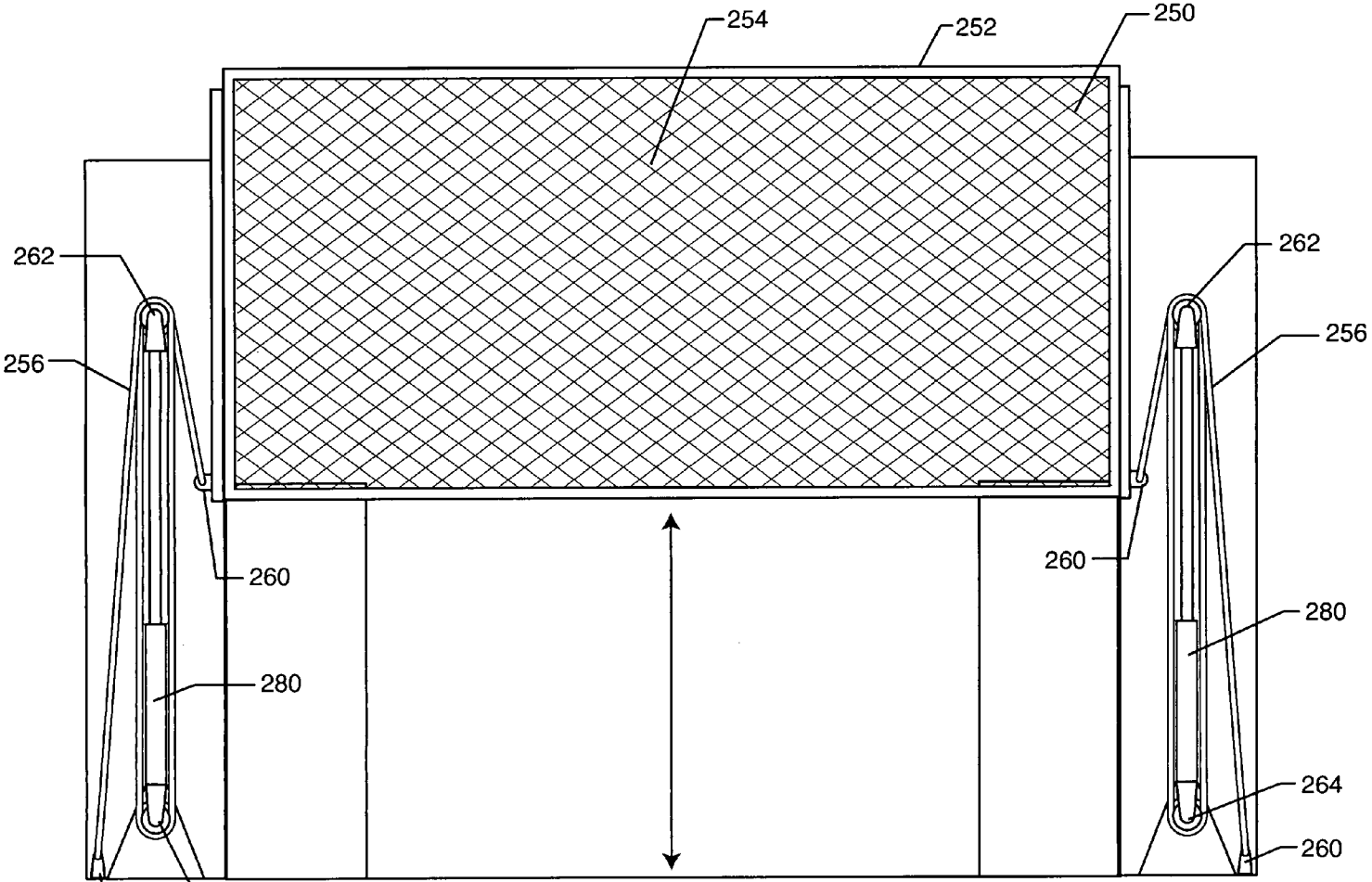
FIG. 11 illustrates a front elevation of an apparatus according to a third embodiment of the invention incorporating a vertically-moving pedestrian fence.

FIG. 11 illustrates a third embodiment of the invention. In this embodiment of the invention, a pedestrian gate 210 is incorporated with barrier 10. Pedestrian gate 210 includes frame 222 and fencing material 224, which may be chain link fencing or the like.

Movement of pedestrian gate 250 is controlled by a pair of hydraulic cylinders 280 acting in conjunction with a system of pulleys and cables. Each cylinder 280 is attached to a pair of pulleys, upper pulley 262 and lower pulley 264. A cable 256 engages pulleys 262 and 264 at each cylinder 280. Each cable 256 is secured to a pair of cable anchors 260, one of which is fixed at grade and other of which is attached to frame 252.

Hydraulic cylinders 280 act simultaneously to raise gate 250 by extending upwards and pulling on cables 256. Lowering of gate 250 is achieved by the simultaneous retraction of hydraulic cylinders 280.

Hydraulic power unit 80 provides the source of hydraulic fluid for hydraulic cylinders 280, as illustrated in FIG. 9. When solenoid valve 286 at valve manifold 284 is activated, hydraulic energy from accumulators 86 is conducted to each of the hydraulic cylinders 280. Valve 288 allows the operator to adjust the flow of hydraulic fluid to hydraulic cylinders 280, and thus allows the rate of travel of gate 250 to be adjusted. Check valve 290 works in conjunction with valve 288 to provide the capability to adjust the flow of hydraulic fluid.

Control and monitoring system 120 may be expanded to provide the capability for the system operator to control and monitor gate 250, as shown in FIG. 9. Panel 132 includes button 140 to open gate 250, and button 142 to close gate 250. Buttons 140 and 142 activate and deactivate solenoid valve 286. Gate position is monitored by gate open switch 168 and gate closed switch 170. The status of the gate is indicated on panel 132 by illumination of gate open lamp 148 or gate closed lamp 150.

The foregoing description of exemplary embodiments of the present invention has been presented for purposes of enablement, illustration, and description. It is not intended to be exhaustive of or to limit the present invention to the precise forms discussed. There are, however, other configurations for security barriers and systems not specifically described herein, but with which the present invention is applicable. The present invention should therefore not be seen as limited to the particular embodiments described herein; rather, it should be understood that the present invention has wide applicability with respect to security barriers and systems. Such other configurations can be achieved by those skilled in the art in view of the description herein. Accordingly, the scope of the invention is defined by the following claims.

The invention claimed is:

1. A security apparatus for spanning an access roadway comprising:

a pair of vertical support structures, one of each said structures on each side of the access roadway;

a substantially horizontal composite beam having opposed first and second ends disposed between said support structures, said beam constructed of steel tubing enclosing an I-beam;

an end cap having a wear plate attached to each of said first and second ends; and a pair of actuators for raising and lowering said beam, one of each said actuators attached to each of said support structures and said beam, whereby, when a moving vehicle strikes said beam, the impact force of the vehicle is transmitted through the beam to the support structures, restraining the vehicle and the beam from horizontal movement.

2. The security apparatus according to claim 1, wherein each of said vertical support structures comprises:

at least two substantially vertical posts having an upper end and a lower end;

a connector plate attached to said posts at said upper ends; and a mounting flange attached to said connector plate.

3. The security apparatus according to claim 1, wherein said actuators are hydraulic cylinders.

4. The security apparatus according to claim 3 further having piping for conducting hydraulic fluid to and from said hydraulic cylinders.

5. The security apparatus according to claim 4, further having a hydraulic control system, said hydraulic control system comprising:

a hydraulic power unit having a source of hydraulic fluid that produces energy therefore;

an accumulator charged with hydraulic energy produced by said hydraulic power unit; and a regulator that regulates the flow of hydraulic energy from said accumulator to said piping and to and from said hydraulic cylinders.

6. The security apparatus according to claim 5, wherein:

said hydraulic power unit includes a pump to pump said hydraulic fluid to thereby create hydraulic energy; and said accumulator is charged with hydraulic energy produced by said pump.

7. The security apparatus according to claim 6, further comprising:

a reservoir distinct from said accumulator and coupled to said pump, said pump coupled between said reservoir and said accumulator to pump hydraulic fluid from said reservoir toward said accumulator to thereby charge said accumulator with hydraulic energy;

a first valve to regulate the flow of hydraulic energy to the hydraulic cylinders; and a second valve that may be selectively actuated to block any flow of hydraulic energy to the hydraulic cylinders.

8. The security apparatus according to claim 7, further comprising:

a third valve to regulate the flow of hydraulic energy from the hydraulic cylinders; and a fourth valve that may be selectively actuated to block any flow of hydraulic energy from the hydraulic cylinders.

9. The security apparatus according to claim 8, further comprising:

a fifth valve to regulate the flow of hydraulic energy to the hydraulic cylinders; and a sixth valve that may be selectively activated to supply hydraulic energy to the hydraulic cylinders.

10. The security apparatus according to claim 5, wherein said regulator is a flow dividing/combining valve.

11. The security apparatus according to claim 5 further including an electronic control system that controls the operation of the hydraulic cylinders in accordance with predetermined commands, said electronic control system comprising:

a programmable logic controller;

a software program embedded in said programmed logic controller; and an electronic control of the hydraulic actuators that controls the rate of actuation within the range of actuation, said electronic control coupled to and controlled by the electronic control system in accordance with the program.

12. The security apparatus according to claim 11, wherein said electronic control has the form of one of a vehicle proximity sensor that provides an electronic signal representative of the location and speed of a vehicle, a manual button that provides a signal commanding said beam to move upwards, a manual button that provides a signal commanding said beam to move downward, and an emergency button that provides a signal commanding said beam to rapidly move upward.

13. The security apparatus according to claim 12, further comprising:

a pedestrian gate having an outer frame and fencing material mounted to the frame;

a fixed path along which the pedestrian gate is moved between an open and closed position, said closed position defined as when said gate is located between said vertical support structures and spanning said access roadway; and driving means associated with said gate to enable movement of the gate between open and closed positions.

14. The security apparatus according to claim 13, wherein said driving means comprises an electric motor and chain drive system.

15. The security apparatus according to claim 13, wherein said driving means comprises a pair of hydraulic cylinders and a pulley and cable system.

16. The security apparatus according to claim 15, further comprising:

a seventh valve to regulate the flow of hydraulic energy to the hydraulic cylinders; and an eighth valve that may be selectively activated to supply hydraulic energy to the hydraulic cylinders.

17. The security apparatus according to claim 14, wherein said electronic control further has the form of a manual button that provides a signal to open the pedestrian gate, a manual button that provides a signal to close the gate, and a manual button that provides a signal to stop the pedestrian gate between the open and closed positions.

18. The security apparatus according to claim 15, wherein said electronic control further has the form of a manual button that provides a signal to open the pedestrian gate, a manual button that provides a signal to close the gate, and a manual button that provides a signal to stop the pedestrian gate between the open and closed positions.

* * * * *